US005692343A

United States Patent [19]

Matsuura et al.

[11] Patent Number: 5,692,343

[45] Date of Patent: Dec. 2, 1997

[54] SURFACE LAYER GROUND ESTABLISHMENT BLOCK, SURFACE LAYER GROUND USING THE SAME AND METHOD FOR UTILIZING THE SAME

[75] Inventors: Tadashi Matsuura; Masakazu Nagase; Kouichi Ushiroda; Akinori Tajiri; Sakae Ebata; Naoto Yoshida; Keiya Sato, all of Hitachi; Tatsuo Makita, Ushiku, all of Japan

[73] Assignees: Hitachi, Ltd.; Hitachi Plant Engineering & Construction Co., Ltd., both of Tokyo, Japan

[21] Appl. No.: 364,982

[22] Filed: Dec. 28, 1994

[30] Foreign Application Priority Data

Dec. 28, 1993 [JP] Japan ..... 5-334893

[51] Int. Cl.[6] ..... E02D 35/00

[52] U.S. Cl. ..... 52/125.2; 52/598

[58] Field of Search ..... 52/122.1, 125.1, 52/125.2, 125.4, 125.6, 309.07, 309.14, 309.16, 533.1, 587.1, 598, 787.1, 125.3; 220/484

[56] References Cited

U.S. PATENT DOCUMENTS

| | | | |
|---|---|---|---|
| 507,562 | 10/1893 | Smith | 52/587.1 X |
| 733,069 | 7/1903 | Murphy | 52/598 |
| 1,045,587 | 11/1912 | Morley | 52/125.4 X |
| 1,403,363 | 1/1922 | Webb, Jr. | 52/598 X |
| 1,452,432 | 4/1923 | Miller | 52/598 |
| 1,934,788 | 11/1933 | Bove et al. | 52/598 |
| 2,321,813 | 6/1943 | Henzel | 52/598 X |
| 2,341,777 | 2/1944 | Hensel | 52/598 |
| 4,992,005 | 2/1991 | Hilfiker | 52/125.2 |

FOREIGN PATENT DOCUMENTS

| | | | |
|---|---|---|---|
| 9403 | 4/1980 | European Pat. Off. | 52/583.1 |
| 712706 | 10/1931 | France | 52/125.4 |
| 4-71196 | 11/1992 | Japan . | |

*Primary Examiner*—Carl D. Friedman
*Assistant Examiner*—Yvonne Horton-Richardson
*Attorney, Agent, or Firm*—Fay, Sharpe, Beall, Fagan, Minnich & McKee

[57] ABSTRACT

A plate structure block for establishing a surface layer ground is formed integrally with an iron plate on an upper surface of a reinforced concrete member. A lift metal fittings for transporting the block is installed on the block. The surface layer ground establishment block has a large ground bearing pressure and is a portable block. This block is covered on the surface layer ground and establishes the ground for operating a heavy material machinery and/or for maintaining a heavy material member. By operating a mobile heavy crane on the established ground, the working for constructing a plant is carried out. The material for constructing the ground is reused, the shape of the ground site is easily changed, and the dismantling and removal of the ground is simplified.

1 Claim, 5 Drawing Sheets

SURFACE LAYER GROUND ESTABLISHMENT BLOCK, SURFACE LAYER GROUND USING THE SAME AND METHOD FOR UTILIZING THE SAME

BACKGROUND OF THE INVENTION

The present relates to a surface layer ground establishment block, a surface layer ground using the same and a method for utilizing the same.

The present invention relates to a technique for simplifying the work related to the establishment and the removal of a ground in an operation area for a large material for a machinery or a maintenance area for a heavy weight product. Such an area requires a large bearing power pressure in accordance with the use of a temporary surface layer ground to which a portable type and recycle practicable ground block is applied.

In an installation working for a heavy weight product in a nuclear power plant and a reprocessing equipment, in addition to a large amount of materials of the product, the weight of a single product is heavy. As a result, it is indispensable to reinforce a ground for use in a mobile heavy crane for installing a product and a ground for maintaining a heavy weight product.

As a ground curing technique able to withstand to the large load, in generally, a ground establishment for reinforcing the surface layer is carried out by a reinforced concrete member. (Hereinafter, in this specification this technique is called as a "prior art technique No. 1").

Further, a technique for covering the surface of the earth by iron plates is employed so as to temporary withstand to the large load. (Hereinafter, in this specification this technique is called as a "prior art technique No. 2").

Also, a reinforcement technique by driving piles against the ground has been known. (Hereinafter, in this specification this technique is called as a "prior art technique No. 3")

The existences of the above stated three kinds prior art techniques are disclosed in, for example, by indicating on column 5, form line 31 to line 37 in Japanese patent laid-open publication No. 71,196/1992.

Because the ground reinforcement technique by the driving piles (prior art technique No. 3) is a time-consuming job, the technique for covering the ground by the iron plates (prior art technique No. 2) can be adopted as a time-saving technique.

However, by using only the iron plates for covering the surface of earth (prior art technique No. 2), since the strength is insufficient and further the iron plates easily slip out of place, the technique for covering the surface of earth using the iron plates (prior art technique No. 2) can merely be temporary utilized.

In the reinforcement technique of the ground according to the above stated prior art technique No. 1, however, a curing period of the reinforced concrete member is needed and thereby an excessively long period is required. Further, it is not taken into consideration about the removal of the reinforcement ground after the completion of the use of the reinforcement ground.

So as to remove this reinforcement ground, the reinforced concrete member forming the surface layer of the ground must be fully crushed to the extent of the sizes able to transport by a transportation machinery such as a bulldozer and a dump truck and further the above crushed reinforced concrete member must be removed.

In a plant construction of the nuclear power station, by using a movable type mobile heavy crane (common name is a crawler crane) as a large scale mobile heavy crane for construction, a product for constituting the nuclear power plant is thereby carried.

As a combination of the prior art techniques, the reinforcement ground has been constituted by using the reinforced concrete member (prior art technique No. 1) and the technique using the iron plates for the covering the surface of earth (prior art technique No. 2).

In a case of the large scale mobile heavy crane which can be carried in a large scale and heavy weight product such as a nuclear power plant constituting product, for example, the ground pressure becomes large (the maximum ground pressure reaches about to the extent of 90 $t/m^2$).

So as to operate the large scale mobile heavy crane having the above stated large ground pressure, the establishment for the strong fundamental ground able to fully withstand the above stated large ground pressure is required.

However, in the case of the nuclear power plant, in an area in which the large scale mobile heavy crane can operate, in other words, in a range used as the fundamental ground, frequently another design material product is arranged in future.

As a result, the ground established for use in the operation of the large scale mobile heavy crane is removed at a time stage when the construction of the nuclear power plant is proceeded and then this large scale mobile heavy crane becomes unneeded.

The conventional fundamental ground for the large scale mobile heavy crane is constituted according to the reinforced concrete member and the iron plate. So as to remove this large scale mobile heavy crane, the reinforced concrete member is needed to be fully crushed to the extent of the sizes able to transport by the transportation apparatus such as a track etc.

Further, it is impossible to reuse at another place the reinforced concrete member which was crushed once as the fundamental ground for the large scale mobile heavy crane.

For the above stated reasons, in the large scale machinery operating area which requires the large bearing power pressure, a temporary reinforcement ground establishing means is required. Such a temporary reinforcement ground establishing means is a portable type and is simply set up and removed and further can be reused.

SUMMARY OF THE INVENTION

A first object of the present invention is to provide a reinforcement ground without a long deal of time and further is to provide a temporary ground block wherein after the completion of the use of the reinforcement ground can be removed without a long deal of time.

A second object of the present invention is to provide a reinforcement surface layer ground using a temporary ground block.

A third object of the present invention is to provide a method for utilizing a temporary ground block.

A fourth object of the present invention is to provide a method for constructing a plant utilizing a temporary ground block.

So as to attain the above stated first object of the present invention, in the present invention has a first means which is a surface layer establishment ground comprising plural blocks for covering a surface layer ground of an establishment portion, the blocks comprises plural reinforced concrete members, plural metal plates, each of plural metal plates is arranged an upper side of each of the plural reinforced concrete members, a fixing member for fixing between each of the reinforced concrete members and each of the metal plates, and a lifting member mounted on each of the metal plates and for lifting the block.

A second means so as to attain the above stated first object of the present invention is a surface layer ground establishment block comprising the block, the block comprises a metal frame mold having a bottom portion, a filling material member filled up in an interior portion of the frame mold, a metal upper lid installed on an upper side of the frame mold, and a lifting member mounted on the frame mold and for lifting the block.

A third means so as to attain the above stated first object of the present invention is a layer surface ground establishment block, the block comprises the filling material member is an urethane styrene member.

A fourth means is a layer surface ground establishment block, and the filling material member is sands and the sands are filled up in the interior portion of the frame mold under a high pressure condition.

A fifth means so as to attain the above stated first object of the present invention is a layer surface ground establishment block, and the upper lid is mounted detachably to the frame mold.

A sixth means so as to attain the above stated first object of the present invention is a layer surface ground establishment block, and a partitioning member is mounted as a reinforcement material member and the partitioning member partitions the frame mold toward the horizontal direction.

A seventh means so as to attain the above stated first object of the present invention is a layer surface ground establishment block, and the partitioning member is constituted with a honeycomb structure.

An eighth means so as to attain the above stated first object of the present invention is a layer surface ground establishment block, and the block has an overlapping portion toward the horizontal direction against an adjacent block.

A ninth means so as to attain the above stated first object of the present invention is a layer surface ground establishment block, and the block has an overlapping portion toward the upper direction and the lower direction against an adjacent block.

A tenth means so as to attain the above stated first object of the present invention is a layer surface ground establishment block, and the block has an overlapping portion toward the horizontal direction, the upper direction and the lower direction against an adjacent block.

An eleventh means so as to attain the above stated first object of the present invention is a layer surface ground establishment block, and the lifting member is mounted detachably to the block.

A twelfth means so as to attain the above stated first object of the present invention is a layer surface ground establishment block, and the lifting member is mounted on a dent portion which is formed on an upper surface of the block.

So as to attain the above stated second object of the present invention, the present invention has a thirteenth means which is a layer surface ground, and the ground comprise plural surface layer ground establishment blocks are covered adjacently.

A fourteenth means so as to attain the above stated second object of the present invention is a layer surface ground, adjusting sands are placed on a surface layer portion of an establishment ground, and at an upper side of the adjusting sands, plural surface layer ground establishment blocks are covered adjacently.

So as to attain the above stated third object of the present invention, the present invention has a fifteenth means which is a method for utilizing surface layer ground establishment blocks, lifting down the surface layer ground establishment blocks by a mobile heavy machinery, establishing a surface layer ground by covering adjacently the plural surface layer ground establishment blocks, and after use of the surface layer ground, removing the plural surface layer ground establishment blocks by lifting up the plural surface layer ground establishment blocks according to the mobile heavy machinery.

A sixteenth means so as to attain the above stated third object of the present invention is a method for utilizing surface layer ground establishment blocks, transporting the removed surface layer ground establishment blocks on a new surface layer ground of a new place, and on the new surface layer ground of the new place, covering and reusing the removed surface layer ground establishment blocks.

A seventeenth means so as to attain the above stated third object of the present invention is a method for utilizing surface layer ground establishment blocks, changing an arrangement of the surface layer ground establishment blocks by lifting up the surface layer ground establishment blocks according to the mobile heavy machinery, and changing a shape and a range of a ground reinforcement area.

So as to attain the above stated fourth object of the present invention, the present invention has a eighteenth means which is a method for constructing a plant, lifting up and reinforcing a surface layer ground establishment ground according to plural mobile heavy machineries on a surface layer of a ground of an operating area of the mobile heavy machineries for construction, covering the surface layer ground establishment ground, reinforcing the surface layer of the ground, and carrying out the carry-in working for a plant constituting product at a predetermined place by operating the mobile heavy machineries for construction on the reinforcement surface layer of the ground.

A nineteenth means so as to attain the above stated fourth object of the present invention is a method for constructing a plant, and before the carry-in working, the plant constituting product is large-assembled.

According to the above stated first means, using the lifting means (lift metal fittings) the block is lifted down on the ground surface layer and covered, and thereby the reinforcement ground is established. In a case of the removal of the block, using the lift metal fittings the block is lifted up and removed.

Since this block has the metal plate (iron plate) at the upper surface thereof, when the heavy weight material product is mounted on the block, the block is hardy injured. Since the block is formed integrally with the iron plate and the reinforced concrete member, the shift hardly occurs and also the warp hardly occurs.

Further, since the load against the iron plate is transferred to the reinforced concrete member and is dispersed, thereby the operation in which the load is easily transferred to the ground surface layer portion can be obtained.

According to the above stated second means, using the lift metal fittings the block is lifted down on the ground surface layer and covered, and thereby the reinforcement ground is established. In a case of the removal of the block, using the lift metal fittings the block is lifted up and removed.

Since this block has the metal plate (iron plate) at the upper surface thereof, when the heavy weight material product is mounted on the block, the block is hardy injured. Since the block is formed integrally with the iron plate and the reinforced concrete member, the shift hardly occurs and the warp hardly occurs.

Further, since the load against the iron plate is transferred to the filling material member and is dispersed, thereby the operation in which the load is easily transferred to the ground surface layer portion can be obtained.

According to the above stated third means, in addition to the operation by the second means, since the filling material member is the urethane styrene member and has the light weight, the operation in which the covering working and the removal working of the block can be easily and quickly carried out can be obtained.

According to the above stated fourth means, in addition to the operation by the second means, since the filling material member is sands, the operation in which during the removal of the block by throwing the sands the block is made the light weight after that the covering working and the removal working of the block can be easily and quickly carried out can be obtained.

According to the above stated fifth means, in addition to the operation by the fourth means, since the upper lid is removed from the frame mold and the sands in the frame mold are easily thrown, the operation according to the fourth means can be promoted.

According to the above stated sixth means, in addition to the operation one selected from the second means to the fifth means, since the partitioning plate is installed in the frame mold, the operation in which the strength of the block is reinforced and the ground is more reinforced can be obtained.

According to the above stated seventh means, in addition to the operation by the sixth means, since the reinforcement material member is installed in the frame mold in the form of the honeycomb structure, the operation in which the ground is more reinforced can be obtained.

According to the above stated eighth means, in addition to the operation one selected from the first means to the seventh means, when the block is covered on the ground surface layer portion, the adjacent blocks are overlapped partially together with toward the horizontal direction, the operation in which even when the heavy weight material product is moved toward the horizontal direction the shift toward the horizontal direction is restrained can be obtained.

According to the above stated ninth means, in addition to the operation one selected from the first means to the seventh means, when the block is covered on the ground surface layer portion, the adjacent blocks are overlapped partially together with toward the upper direction and the lower direction, the operation in which even when the heavy weight material product is moved toward between the adjacent blocks the weight of the block is dispersedly taken the charge can be obtained.

According to the above stated tenth means, in addition to the operation one selected from the first means to the seventh means, both operations by the eighth means and the ninth means are added, the operation in which the lowering in strength by the boundary portion between blocks is restrained can be obtained.

According to the above stated eleventh means, in addition to the operation one selected from the first means to the tenth means, the operation in which after the block is covered the lift metal fittings is removed from the block and the flat upper surface able to move the heavy material product is provided can be obtained.

According to the above stated twelfth means, in addition to the operation one selected from the first means to the eleventh means, the operation in which since the lift metal fittings is mounted on the recess without removing the lift metal fittings from the block and the flat upper surface able to move the heavy material product is provided can be obtained.

According to the above stated thirteenth means, by covering the surface layer ground establishment block according to one selected from the first means to the twelfth means, since the reinforcement surface layer ground is provided and further since the laying is carried out by covering the surface layer ground establishment block, the operation in which the reinforcement of the establishment ground can be easily carried out and also the removal of the block is carried out every block each can be obtained.

As a result, the surface layer ground in which the ground reinforcement of the establishment ground and the removal of the reinforcement equipment are easily carried out can be obtained.

According to the above stated fourteenth means, in addition to the operation by the thirteenth means, by placing the adjusting sands on the ground to lessen the uneven portions of the ground, the flatting degree of plural blocked placed on the adjusting sands is builded and also by adjusting the amount to be placed of the adjusting sands, the operation in which the sinking amount between the plural blocks is fatten can be obtained. As a result, the operation for obtaining the flat reinforcement ground can be obtained.

According to the above stated fifteenth means, with a deal by dividing the surface layer ground establishment blocks according to one selected from the first means to the twelfth means through the mobile heavy crane, the operation in which the reinforcement of the ground and the removal after the use of the ground can be easily and quickly carried out can be obtained.

According to the above stated sixteenth means, in addition to the operation by the fifteenth means, the operation in which the surface layer establishment block is reusable can be obtained.

According to the above stated seventeenth means, with a deal by dividing the surface layer ground establishment blocks according to one selected from the first means to the twelfth means through the mobile heavy crane, the operation in which by changing the arrangement of the ground the shape and the range of the reinforcement ground area is changed can be obtained.

According to the above stated eighteenth means, by covering the surface layer establishment block according to one selected from the first means to the twelfth means on the surface layer of the ground of the mobile heavy crane for construction, the operation in which the reinforcement ground bearable the load accompanied to the mobile heavy crane for construction is quickly established and the starting period for the plant construction is advanced can be obtained.

According to the above stated nineteenth means, in addition to the operation by the eighteenth means, since the ground is reinforced, even when the large-assembled plant constituting product is lifted up by the mobile heavy crane, the total weight can be received by the reinforcement ground without obstructing the carrying-in working for the plant constituting product.

As a result the number of carrying-in workings is lessened and the shortening of the construction period of the plant construction is attained.

DESCRIPTION OF THE INVENTION

Figure 1:
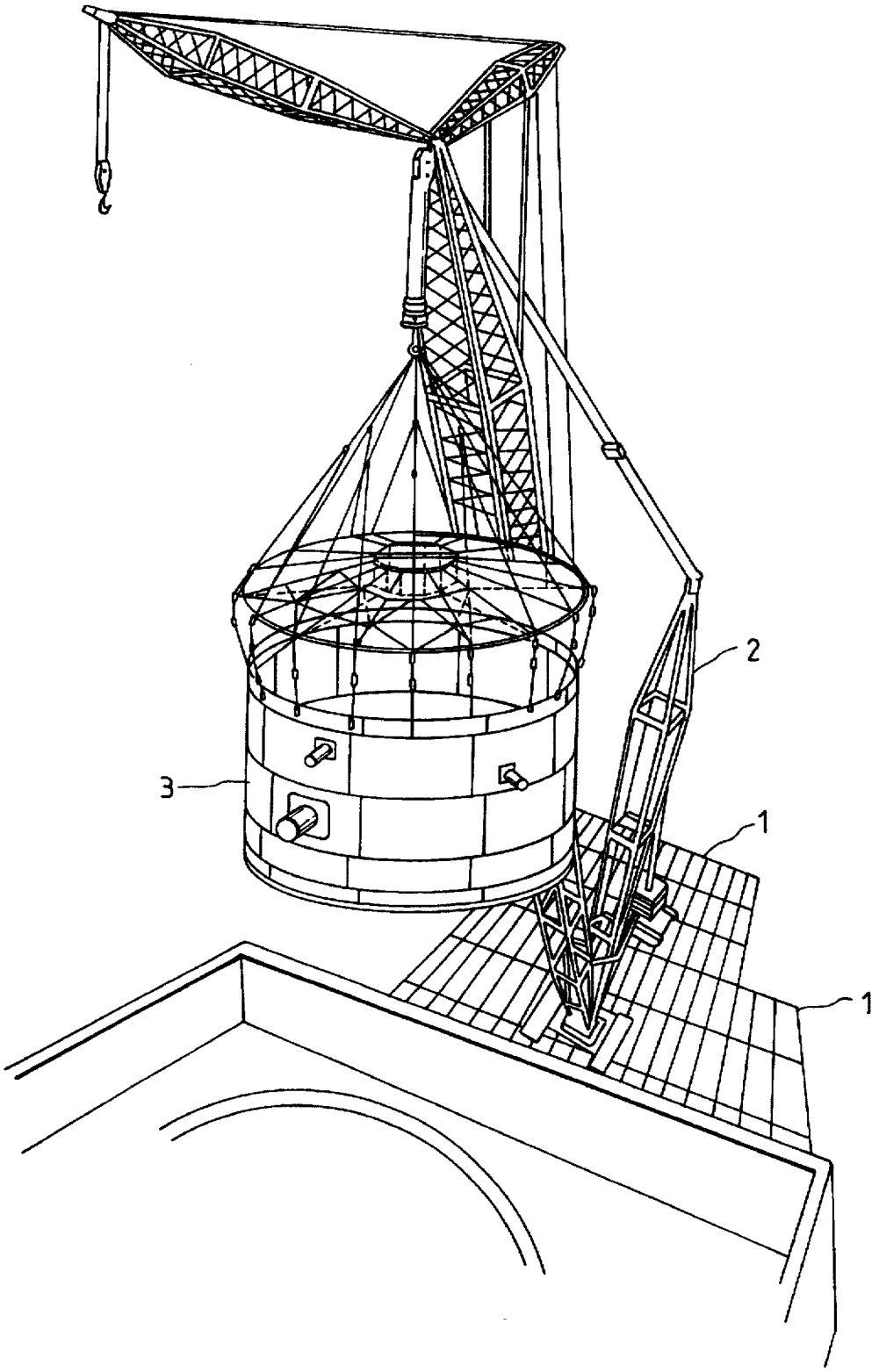
FIG. 1 is a view showing a working scene showing a lift working state of a plant constructing product on a reinforcement ground according to the present invention.

Hereinafter, one embodiment of a method for constructing of a ground block according to the present invention will be explained referring to the drawings.

The ground block is a portable type and a recycle practicable type and this ground block is adopted in a large scale machinery operating area which requires a large ground pressure.

FIG. 1 shows a state in which a portable and temporary ground block is adopted in a temporary fundamental ground.

In a large scale machinery operating area, the portable and temporary block 1 (Hereinafter, in this specification it is called merely as a "block 1") is a portable and recycle practicable type.

In the construction of a nuclear power plant, the block 1 is adopted as the temporary fundamental ground of an operation area for a movable type large scale mobile heavy crane 2 which is used for carrying-in a product.

In the construction for the nuclear power station, using the movable type mobile heavy crane (it is commonly called as a "crawler crane") as shown in figure, which is a large scale construction mobile heavy crane, a lifting and carrying-in of a nuclear power plant constituting product 3 is carried out.

Before a lift carrying-in working, this nuclear power plant constituting product 3 is practiced to module by large-assembling according to the assemble of the respective parts.

In a case of the movable type large scale mobile heavy crane 2 which can be carried in the large scale and heavy weight product such as the nuclear power plant constituting product, the ground pressure of this mobile heavy crane 2 becomes large (at the maximum about 90 t/m$^2$).

So as to operate the movable type large scale mobile heavy crane 2 having the large ground pressure, it is necessary to establish the strong fundamental ground which can fully withstand to the above stated large ground pressure.

However, in the case of the nuclear power plant, in an area in which the movable type large scale mobile heavy crane can operate, in other words, in a range used as the fundamental ground, another lasting design material product is arranged frequently.

Thereby, the ground established for use in the operation of the movable type large scale mobile heavy crane 2 is removed at a time stage when the construction of the nuclear power plant is proceeded and then this movable type large scale mobile heavy crane 2 becomes unneeded.

So as to remove the reinforcement ground, the size of the block 1 for constituting the reinforcement ground is formed to have the size which can be transported by a transportation apparatus such as a track etc.

Both the loading and unloading of the block 1 to the transportation machinery such as a track and the covering and the removal of the block 1 to the ground are carried out by utilizing the mobile heavy crane 2.

The surface layer establishment ground is constituted by employing plural blocks 1.

The block 1 is formed the transportable size and is transported to a new place and works to perform the reuse.

As stated in above, the present invention can adopt to a plant construction.

In the large scale machinery operating area which requires the large ground pressure, the portable and recycle practicing block 1 according to the present invention can be simply set up and removed. Further, the block 1 according to the present invention is extremely valid in the establishment for the reusable and temporary reinforcement ground.

A detailed construction of the block 1, a method for establishing the ground using the block 1 and a method for utilizing and a method for removing the block 1 will be explained in FIG. 2 etc.

Figure 2:
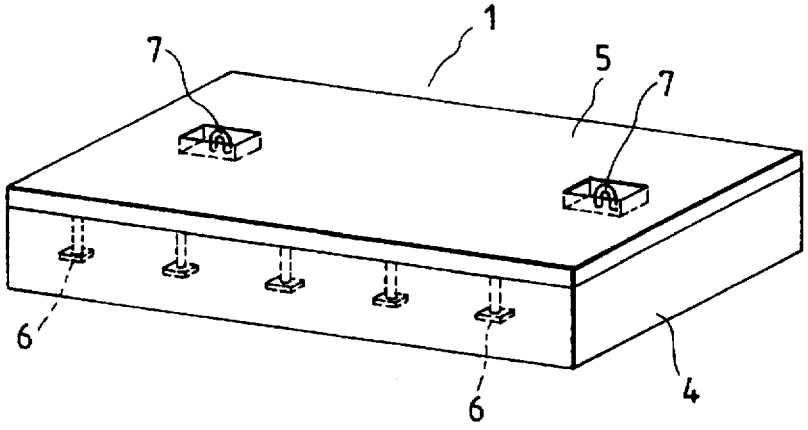
FIG. 2 is an enlarged view showing a block portion shown in FIG. 1 of a first embodiment according to the present invention.

FIG. 2 shows a block 1 having a reinforced concrete member 4 as a base member of a first embodiment according to the present invention.

An iron plate 5 is provided so as to cover an upper side surface of a reinforced concrete member 4.

A stud dowel (connector) 6 is provided on the iron plate 5 and this stud dowel 5 is placed to firmly fix the reinforced concrete member 4 to the iron plate 5.

A plate structure block is constituted by a complex material of the reinforced concrete member 4 and the iron plate 5 which is constituted according to the above.

A lift metal fittings 7 for transportation is mounted on the iron plate 5 and this lift metal fittings 7 is able to do the carrying-in and the lift transportation by the mobile heavy crane 2.

In this embodiment according to the present invention, two lift metal fittings 7 are symmetrically installed on the rectangular shape block 1.

In this time, a box like recess is provided in a surrounding portion of the lift metal fittings 7 of the iron plate 5 and the lift metal fittings 7 is received in this recess, thereby a flat shape temporary ground can be set up.

Figure 3:
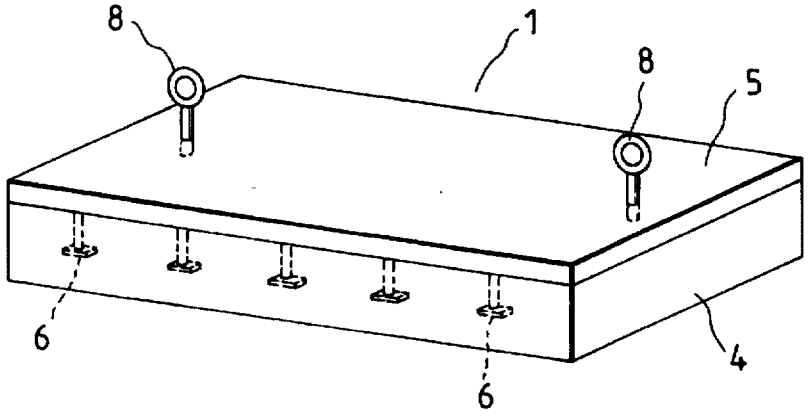
FIG. 3 is an enlarged view showing a block of a second embodiment according to the present invention.

FIG. 3 shows a block having a reinforced concrete member as a base member of a second embodiment according to the present invention.

In this second embodiment of the present invention, the lift metal fittings 7 is not a fixture type construction as shown in FIG. 2, but an eye bolt 8 as shown in FIG. 3 is screwed in the block 1 by forming a screwed hole in the iron plate 5. In a case of the use for the ground this eye bolt 8 is removed and the surface of the block 1 is made to form the flatten surface.

Other construction of the block 1 of the second embodiment shown in FIG. 3, except for the lift metal fitting 7 and the recess, is same of the block 1 of the first embodiment shown in FIG. 2.

Figure 4:
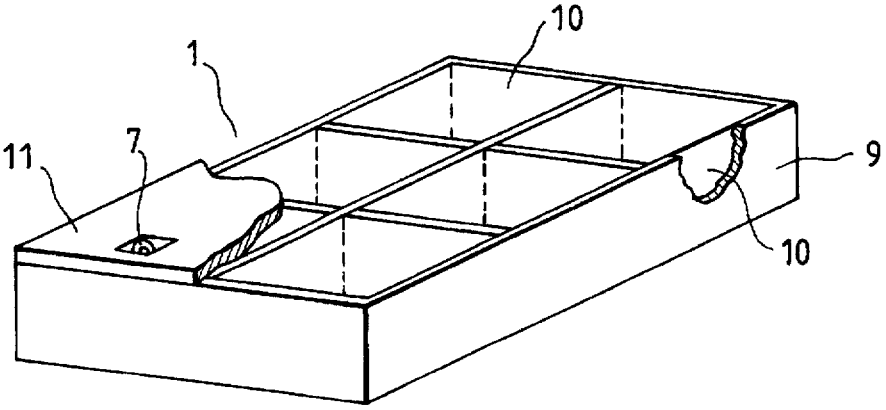
FIG. 4 is an enlarged view showing a block of a third embodiment according to the present invention in which the block is partially cut off.

FIG. 4 shows a block having a reinforced concrete member as a base member of a third embodiment according to the present invention.

In FIG. 4, a filling material member 10 is filled up in a steel frame mold 9 under a high pressure, to this frame mold 9 by installing an iron upper lid 11 an anti-weight construction block 1 is formed.

The frame mold 9 is reinforced by a quadrilateral lattice shape partitioning plate. This partitioning plate partitions the frame mold 9 by dividing plural rooms.

In this third embodiment, the portable type ground block 1 can provide the lift metal fittings 7, thereby the installation property and the removal property of the ground block 1 can be improved.

In this case, a box like recess can be provided in a surrounding portion of the lift metal fittings 7 of the iron plate 5 and the lift metal fittings 7 is received in this recess, thereby a flat shape temporary ground can be set up.

As the filling material member 10, for example, the sands, an urethane styrene can be employed.

In a case that the sands are employed as the filling material member 10, after the temporary frame mold is set up on a spot place, the filling-up sands are filled up and adding under the pressure the iron upper lid 11 is installed.

When the iron upper lid 11 is installed to the steel frame mold 9 by a bolt fastening means, since at removal time of the block 1 the filling-up sands can be removed from the block 1, the light weight for the block 1 during the transportation can be attained.

Further, when the urethane styrene is employed as the filling material member 10, the weight of the portable ground block 1 itself can be more light more comparing with a case of the employ of the use of other filling material member.

In this case, the joining between the steel frame mold 9 and the iron upper lid 11 may be carried out by the bolt fastening. However, since the filling material member 10 has the light weight, at the transportation time the removal of the filling material member 10 is unneeded, thereby the joining may be carried out by the welding method.

A fourth embodiment of the block 1 according to the present invention will be explained referring to FIG. 5.

Figure 5:
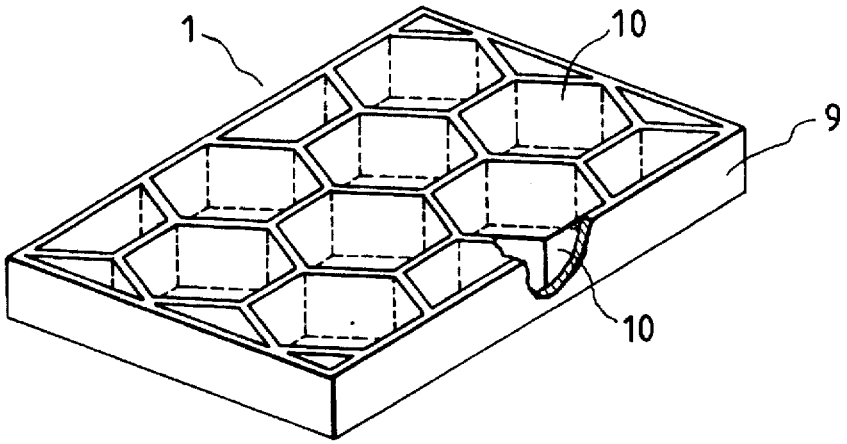
FIG. 5 is an enlarged view showing a block of a fourth embodiment according to the present invention in which a part of the block is partially cut off.

In the fourth embodiment of the block 1, as shown in FIG. 5, the partitioning plate is constituted of a honeycomb structure, the block 1 is further reinforced, thereby the strength of the frame mold 9 itself can be heighten.

However, not shown in FIG. 5, the iron upper lid 11 and the lift metal fittings 7 are provided on the block 1.

The other construction of the block 1 of the fourth embodiment shown in FIG. 5 has the similar construction of the block 1 of the third embodiment shown in FIG. 4.

The shape of the rectangular form block 1 shown in FIG. 2, FIG. 3, FIG. 4 and FIG. 5 is the most simplified shape for the block 1. Namely, this portable type and recycle practicing block 1 is utilized at the large scale machinery operating area, which requires the large ground pressure, in which the present invention can be adopted.

The merits of the use of the rectangular form block 1 are that the concrete frame mold is assembled at the spot place for setting up the ground, and the installation place the filling up of the concrete member 4 or the filling-up of the filling material member 10 can be carried out.

Besides, with the relationship of the contact ground pressure, when the formation of a floor plate (an upper layer)in which each of the blocks 1 is formed with the continuing state is preferable in designing a lower layer ground, the blocks may select the shape of the block 1 under the consideration of the Joining the adjacent block. The floor plate is a mixed material member composed of the upper layer (the block) and the lower layer ground.

Figure 6:
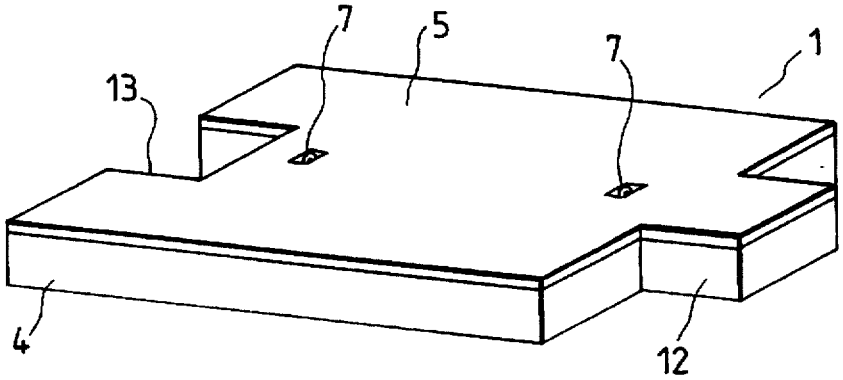
FIG. 6 is an enlarged view showing a block of a fifth embodiment according to the present invention in which the block is partially cut off.

Next, FIG. 6 shows a block 1 of a fifth embodiment according to the present invention.

The block 1 of the fifth embodiment according to the present invention exemplifies the shape of the block 1. This block 1 has the shape to lessen the sift toward the horizontal lateral direction.

This portable type and recycle practicing block 1 is utilized at the large scale machinery operating area which requires the large ground pressure.

In this case of this block 1, a protrude portion 12 of the block 1 and a dent portion 13 of the block 1 are provided at the horizontal direction of the plate shape block 1.

The protrude portion 12 and the dent portion 13 of the block 1 are fitted into an adjacent protrude portion 12 and an adjacent dent portion 13 of the block 1 and further they are overlapped with the adjacent protrude portion 12 and the adjacent dent portion 13.

By overlapping between the protrude portion 12 and the dent portion 13 and the adjacent protrude portion 12 and the adjacent dent portion 13 of the block 1, the shift toward the horizontal direction between the mutual adjacent block 1 can be restrained.

The other construction of the block 1 of the fifth embodiment shown in FIG. 6 is the same of the construction of the block 1 of the first embodiment shown in FIG. 1.

Figure 7:
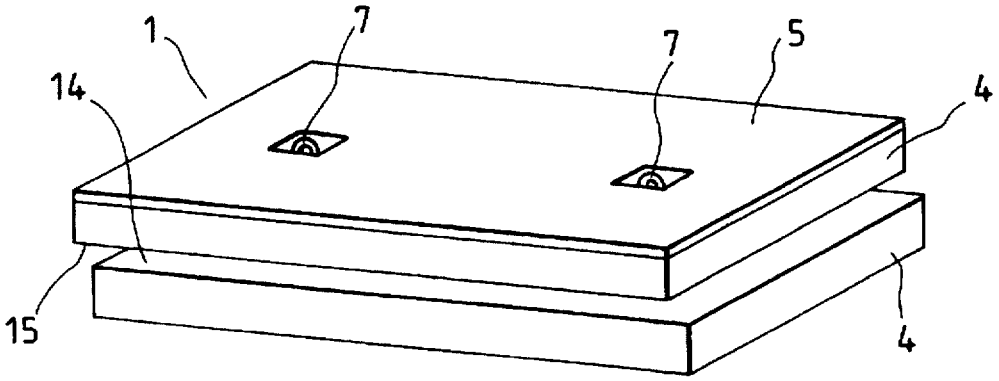
FIG. 7 is an enlarged view showing a block of a sixth embodiment according to the present invention in which the block is partially cut off.

FIG. 7 shows a block of a sixth embodiment according to the present invention.

The block 1 of the sixth embodiment according to the present invention exemplifies the block 1 in which the mutual adjacent blocks 1 are partially overlapped at the adjacent portion toward the upper direction and the lower direction. This block 1 has the construction to improve the joining property and retrain the shift of the mutual blocks 1 at the vertical direction.

This portable type and recycle practicing block 1 is utilized at the large scale machinery operating area which requires the large ground pressure.

Figure 8:
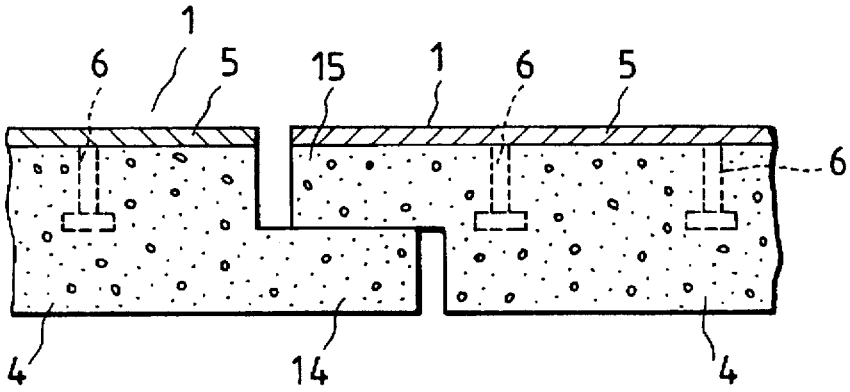
FIG. 8 is a longitudinal cross-sectional view showing a boundary portion between blocks in a case in which plural blocks shown in FIG. 7 are covered.

In this case, at the setting up of the block 1, as shown in FIG. 8, a lower projecting portion 14 of the block 1 is arranged to receive an upper projecting portion 15 of the block 1.

The lower projecting portion 14 of the block 1 is constituted to form a thin thickness portion around a whole outer periphery portion, and also the upper projecting portion 15 of the block 1 is constituted to form a thin thickness portion around a whole outer periphery portion. Accordingly, the shift at the vertical direction of the mutual blocks 1 can be restrained.

The other construction of the block 1 of the sixth embodiment shown in FIG. 7 is the same of the construction of the block 1 of the first embodiment shown in FIG. 2.

Figure 9:
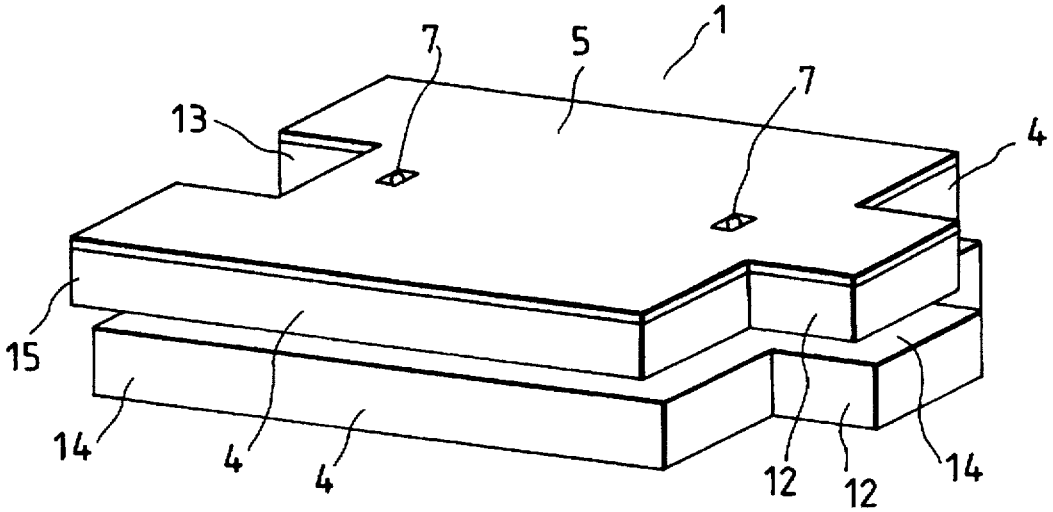
FIG. 9 is an enlarged view showing a block of a seventh embodiment according to the present invention in which the block is partially cut off.

FIG. 9 shows a block of a seventh embodiment according to the present invention. The block 1 of the seventh embodiment shown in FIG. 9 has a complex block shape.

At the setting-up of the blocks 1, the horizontal direction protrude portion 12 of the block 1 is matched to the vertical direction dent portion 13 of the block 1, thereby the shift toward the horizontal direction of the mutual blocks 1 can be restrained.

Further, at the same time, the lower projecting portion 14 of the block 1 is arranged to receive the upper projecting portion 15 of the block 1, thereby the shift toward the vertical direction of the mutual blocks 1 can be restrained.

According to this seventh embodiment according to the present invention, both the shift toward the vertical direction of the block 1 and the shift toward the horizontal direction of the block 1 can be restrained.

The other construction of the block 1 of the seventh embodiment shown in FIG. 8 is the same of the construction of the block 1 of the first embodiment shown in FIG. 2.

Next, an arrangement example of the block 1 shown in FIG. 10 to the ground will be explained.

Figure 10:
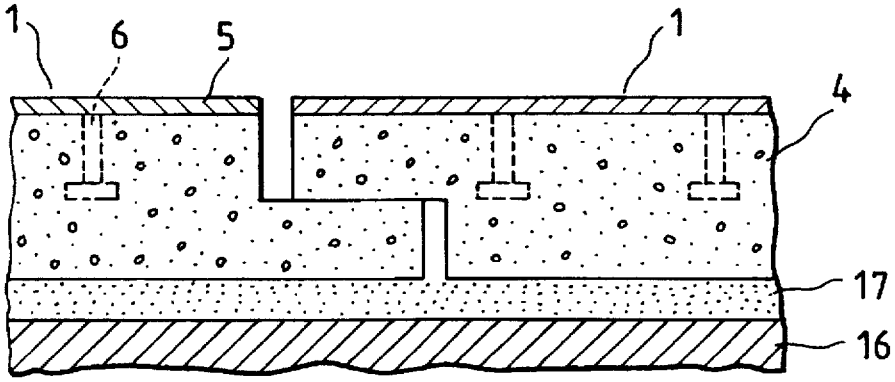
FIG. 10 is a longitudinal cross-sectional view showing a set-up state to a block according to the present invention at a boundary portion between blocks.

FIG. 10 is an arrangement example of a portable and recycle practicing block 1 for use in the large scale machinery operating area which requires the large contact ground pressure.

So as to set up the portable and recycle practicing block 1 for use in the large scale machinery operating area which requires the large contact ground pressure, an improvement ground 16 is set up an area establishment range and after the adjusting sands are covered and made to be flatten as shown in FIG. 10.

After the completion of the flatten condition, using the mobile heavy crane 2 plural blocks 1 are carried in and are set up by partially overlapping as stated in the above at a predetermined position of the operating area of the mobile heavy crane 2 for construction.

When one side of the adjacent blocks 1 is estimated to have the large sinking amount, the large amount adjusting sands are put on below the block 1.

Further, so as to carry out the stronger ground establishment, on the improvement ground 16 the concrete member is conducted and on the above the adjusting sands 17 are covered. After that, it is possible to set up the portable and recycle practicing block 1 for use in the large scale machinery operating area which requires the large contact ground pressure.

Further, when the ground curing is intended to make simplify, by omitting the establishment of the improvement ground 16 the ground establishment may be completed, the setting up of the portable and recycle practicing block 1 for use in the large scale machinery operating area which requires the large contact ground pressure.

Figure 11:
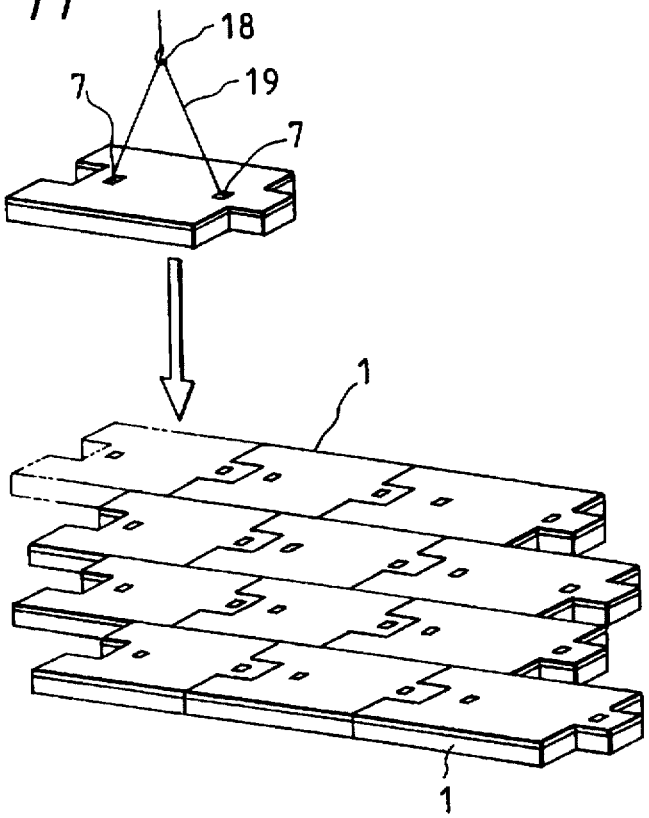
FIG. 11 is a view showing a covering working state of a block of the sixth embodiment according to the present invention.

FIG. 11 shows a method for setting up of the portable and recycle practicing block 1 shown in FIG. 6 for use in the large scale machinery operating area which requires the large contact ground pressure according to the present invention.

So as to set up the portable and recycle practicing block 1 for use in the large scale machinery operating area which requires the large contact ground pressure according to the present invention at a predetermined area of the spot place, a wire 19 is hung between the lift metal fittings 7 of the block 1 and a hock portion 18 of the mobile heavy crane 2.

Using the mobile heavy crane 2 the block 1 is lifted up and moved at a predetermined position and after the block 1 is lifted down and is set up.

Further, when the block 1 is removed from the predetermined area, the wire 19 is hung to the lifting metal fittings 7 of the block 1 and using the mobile heavy crane 2 the block 1 is lifted up and is carried out.

The block 1, which is removed from the large scale machinery operating area which requires the large ground pressure, can be reusable by moving to another place.

At the same area or the adjacent area, when the range for requiring the ground curing is changed, it is possible to correspond by the movement of the portable and recycle practicing ground block 1 for use in the large scale machinery operating area which requires the large contact ground pressure using the mobile heavy crane 2.

Figure 12:
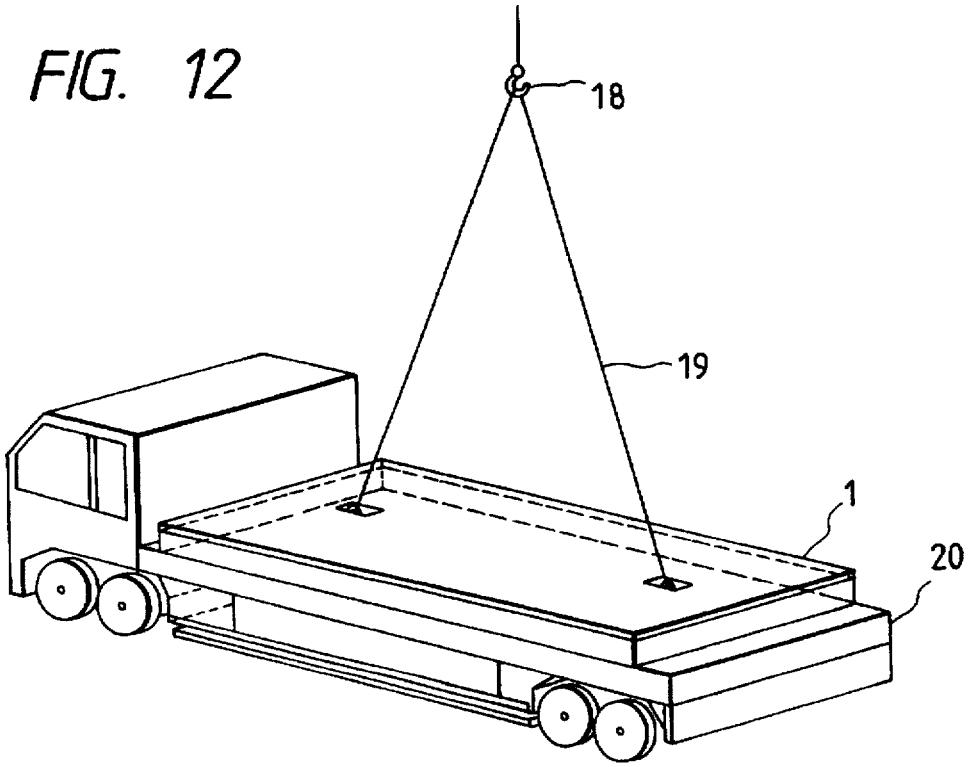
FIG. 12 is a view showing a loading working state of a block according to the present invention to a track.

Further, the removed ground block 1 is reused by setting up the place remote from the original place, as shown in FIG. 12, the block 1 is carried in to a track 20 or a trailer and is transported to a next use area and is reused at the place.

As an adoption example of the block 1 according to the present invention, in addition to the ground of the operating area for the movable type large scale mobile heavy crane, a temporary warehouse ground for holding the valuables, a materials yard ground, a temporary road ground and a simple runway ground are exemplified.

The block 1 according to each of the various embodiments can be utilized as the above stated utilization matter.

According to the surface layer establishment ground of the present invention, by using the temporary ground block according the present invention, following effects will be expected.

(1) The material for the surface layer establishment ground can be reusable.

(2) The shape of the surface layer establishment ground site can be easily varied in the midway of use.

(3) The dismantle working and the removal working of the surface layer establishment ground can be remarkably simplified.

According to the surface layer ground establishment block of the present invention, not relying the reinforced concrete member, the same effects obtained by the above stated surface layer establishment ground of the present invention can be obtained.

According to one example of the surface layer establishment ground of the present invention, in addition to the above effects obtained by the above stated present invention with respect to the surface layer establishment ground, the effect in which the covering working and the removal working of the block according to the light weight of the block can be easily and quickly attained can be obtained.

According to another example of the surface layer establishment ground of the present invention, in addition to the above effects obtained by the above stated one example with respect to the surface layer establishment ground, since the filling material member is the sands which can be easily obtained and thrown, the effect that the covering working and the removal working of the block can be easily and quickly attained can be obtained.

According to a further first example of the surface layer establishment ground of the present invention, in addition to the above effects obtained by the another example with respect to the surface layer establishment ground, since the sands as the filling material member are easily filled up and thrown, the effect that the covering working and the removal working of the block be more easily and more quickly attained can be obtained.

According to a further second example of the surface layer establishment ground of the present invention, in addition to the above effects obtained by one selected from the above stated present invention to the further first example with respect to the surface layer establishment ground, since each of the blocks is reinforced by the partitioning plate, the effect in which the strength of the ground using the above blocks is more improved can be obtained.

According to a further third example of the surface layer establishment ground of the present invention, in addition to the above effects obtained by the further second example with respect to the surface layer establishment ground, the effect in which the ground is more strengthen can be obtained.

According to a further fourth example of the surface layer establishment ground of the present invention, in addition to the above effects obtained by one selected from the above stated present invention to the further third example with respect to the surface layer establishment ground, in the case that the blocks are covered, since the horizontal direction shift between blocks is restrained, the effect in which the normal strengthen ground surface is maintained can be obtained.

According to a further fifth example of the surface layer establishment ground of the present invention, in the case that the blocks are covered, since the boundary portion between the blocks is overlapped toward the upper direction and the lower direction, the effect in which the normal strengthen ground surface is maintained in the boundary portion can be obtained.

According to a further sixth example of the surface layer establishment ground of the present invention, the synergistic effect of the combination the fourth example and the fifth example with respect to the surface layer establishment ground can be obtained.

According to a further seventh example of the surface layer establishment ground of the present invention, in addition to the above effects obtained by one selected from the above stated present invention to the further seventh example with respect to the surface layer establishment ground, in the case that the block are used to covered, without the projection of the lift metal fittings, the effect in which the flat ground surface is obtained can be obtained.

According to a further eighth example of the present invention, in addition to the above effects obtained by one selected from the above stated present invention to the further seventh example with respect to the surface layer establishment ground, in the case that the blocks are used by covering, without disarrangement of the lift metal fittings, the effect in which the flat ground surface is obtained without the projection of the lift metal fittings can be obtained.

According to the surface layer ground of the present invention, the effect for providing the surface layer ground in which the ground reinforcement of the establishment ground and the removal of the reinforcement equipment is easily attained can obtained.

According to one example of the surface layer ground of the present invention, in addition to the above effect obtained by the above stated present invention with respect to the surface layer ground, the effect in which the flatting degree of the reinforcement surface layer ground is easily attained can be obtained.

According to the method for utilizing the surface layer ground establishment blocks of the present invention, the effect in which the reinforcement of the ground and the removal after the utilization is easily and quickly attained can obtained.

According to one example of the method for utilizing the surface layer ground establishment blocks of the present invention, in addition to the above effect obtained by the above stated present invention with respect to the method for utilizing the surface layer ground establishment block, the effect in which the economic effect is heighten by using the reuse of the block can be obtained.

According to another example of the method for utilizing the surface layer ground establishment blocks of the present invention, in addition to the above effects obtained by one selected from the above stated present invention to the one example with respect to the method for utilizing the surface layer ground establishment block, the effect in which the shape and the range of the reinforcement ground is easily changed can be obtained at the same time.

According to the method for constructing the plant of the present invention, the effect in which the starting time for the plant construction is advanced can be obtained at the same time.

According to one example of the method for constructing the plant of the present invention, in addition to the above effect obtained by the above stated present invention with respect to the method for constructing the plant, the effect in which the shortening of the time of works is attained can be obtained.

What is claimed is:

1. A surface layer establishment ground having a plurality of blocks for covering a surface layer ground of an establishment portion, wherein each block comprises:

a plurality of reinforced concrete members;

a plurality of metal plates, each of the plurality of metal plates being arranged on an upper side of each of said plurality of reinforced concrete members;

a fixing member for connecting said plurality of reinforced concrete members and said plurality of metal plates; and a lifting member mounted on each of said metal plates and for lifting.

* * * * *